US011849839B2

(12) United States Patent
Nilsson

(10) Patent No.: US 11,849,839 B2
(45) Date of Patent: Dec. 26, 2023

(54) SHELF STORAGE SYSTEM

(71) Applicant: Elfa International AB, Västervik (SE)

(72) Inventor: Peter Nilsson, Västervik (SE)

( * ) Notice: Subject to any disclaimer, the term of this patent is extended or adjusted under 35 U.S.C. 154(b) by 0 days.

(21) Appl. No.: 17/788,305

(22) PCT Filed: Dec. 21, 2020

(86) PCT No.: PCT/SE2020/051246
§ 371 (c)(1),
(2) Date: Jun. 23, 2022

(87) PCT Pub. No.: WO2021/133240
PCT Pub. Date: Jul. 1, 2021

(65) Prior Publication Data

US 2023/0026525 A1 Jan. 26, 2023

(30) Foreign Application Priority Data

Dec. 23, 2019 (SE) ..... 1951548-5

(51) Int. Cl.
*A47B 57/42* (2006.01)
*A47B 96/02* (2006.01)
(Continued)

(52) U.S. Cl.
CPC ..... *A47B 57/42* (2013.01); *A47B 96/028* (2013.01); *A47B 96/061* (2013.01); *A47B 96/1408* (2013.01); *A47F 5/103* (2013.01)

(58) Field of Classification Search
CPC ... A47B 57/42; A47B 96/1408; A47B 96/061; A47B 96/028; A47B 96/145;
(Continued)

(56) References Cited

U.S. PATENT DOCUMENTS 2,562,290 A 7/1951 Backus
2,622,834 A * 12/1952 Sparring ..... A47B 57/42 248/243
(Continued)

FOREIGN PATENT DOCUMENTS

CA 2737714 A1 10/2012
CN 2648906 Y 10/2004
(Continued)

OTHER PUBLICATIONS

Elfa Creating Space, Product List 2019/20 Interior, 940983, Ver. 1, Jan. 2020, 84 pages.
(Continued)

*Primary Examiner* — Jennifer E. Novosad
(74) *Attorney, Agent, or Firm* — Marc A. Hubbard; Hubbard Law, PLLC

(57) ABSTRACT

A shelf storage system includes hang standards with slots arranged in rows, brackets connectable to the slots to suspend them in a cantilevered manner from the hang standards, and shelves adapted to be supported by brackets when suspended on spaced-apart hang standards. On the bottom side of a shelf are connectors at fixed locations for connecting the shelf to brackets when spaced a predetermined bracket-to-bracket distance apart. The hang standards have a plurality screw holes to connect the hang standard vertically on a vertical surface, such as a wall. The distance between at least two such screw holes corresponds to the predetermined bracket-to-bracket distance. To mark locations to install hang standards with proper spacing for brackets suspended from them to connect with the shelf, one of the hang standards is placed horizontally on the vertical surface to mark locations for the hang standards using the screw holes, thus simplifying installation of the system.

13 Claims, 5 Drawing Sheets

(51) Int. Cl.
*A47B 96/06* (2006.01)
*A47B 96/14* (2006.01)
*A47F 5/10* (2006.01)

(58) Field of Classification Search
CPC ... A47B 96/1458; A47B 96/02; A47B 96/027; A47B 96/14; A47B 96/1433; A47B 47/022; A47B 57/16; A47B 57/30; A47B 57/425; A47F 5/103; A47F 5/08; A47F 5/101
USPC ..... 211/187, 103, 193
See application file for complete search history.

(56) References Cited

U.S. PATENT DOCUMENTS 2,644,591 A 7/1953 Mcmahan
2,653,783 A * 9/1953 Lindsay ..... A47B 57/42 248/243
2,661,993 A 12/1953 Little
2,783,961 A * 3/1957 Weber ..... A47B 57/42 108/108
2,833,420 A * 5/1958 Streater ..... A47B 57/42 248/250
2,883,137 A * 4/1959 Weber ..... A47B 57/045 248/243
2,919,033 A 12/1959 Lundqvist
2,921,693 A 1/1960 McLean
2,997,269 A * 8/1961 Urbain ..... A47B 57/52 108/106
3,018,900 A * 1/1962 Huet ..... A47B 57/42 211/187
3,097,822 A * 7/1963 Attwood ..... A47B 57/045 248/250
3,136,520 A * 6/1964 Reiss ..... A47B 57/42 248/243
3,278,248 A 10/1966 Torok
3,325,129 A 6/1967 Tinfow
3,331,514 A 7/1967 Bruynzeel
3,396,499 A 8/1968 Biffani
3,439,812 A * 4/1969 Preston ..... F16B 12/20 403/231
3,510,010 A 5/1970 Gasner
3,563,182 A 2/1971 MacFarlane
3,592,493 A 7/1971 Goose
3,601,347 A 8/1971 Attwood
3,645,486 A 2/1972 Ferdinand
3,671,061 A 6/1972 Dawdy
3,765,344 A 10/1973 Ferdinand
3,771,466 A 11/1973 Ferdinand
D230,116 S 1/1974 Beams
3,828,937 A 8/1974 Nash
3,848,844 A 11/1974 Barrett
3,865,336 A 2/1975 Robertson
3,966,158 A * 6/1976 Boundy ..... A47B 57/42 248/220.22
3,993,002 A 11/1976 Stroh
4,069,638 A 1/1978 Hasselqvist
4,285,484 A 8/1981 Follows
4,312,086 A 1/1982 Bianco
4,411,400 A 10/1983 Everett
4,711,420 A 12/1987 Cowler
4,735,470 A 4/1988 Falk
4,816,205 A 3/1989 Remy
4,850,285 A * 7/1989 Suttles ..... A47F 5/103 211/187
4,938,442 A 7/1990 Mastrodicasa
4,944,566 A 7/1990 Carper
4,995,323 A * 2/1991 Kellems ..... A47B 96/00 108/157.13
5,004,198 A 4/1991 Jager
5,004,201 A 4/1991 Bessinger
5,007,608 A 4/1991 Carroll, Jr.
5,014,902 A 5/1991 Heimendinger
5,074,009 A 12/1991 Simonton
5,110,080 A 5/1992 Rieman
D327,839 S 7/1992 Stumpf
5,135,194 A 8/1992 Laughon
D342,015 S 12/1993 Andrejew
5,348,385 A 9/1994 Berg
5,377,851 A 1/1995 Asano
5,472,103 A 12/1995 Merl
5,509,541 A 4/1996 Merl
5,531,416 A 7/1996 Remmers
5,551,772 A 9/1996 Keffer
5,638,644 A 6/1997 Bastian
5,720,230 A 2/1998 Mansfield
5,794,903 A * 8/1998 Peterson, II ..... A47B 97/00 248/300
D406,476 S 3/1999 Boije
D407,011 S 3/1999 Boije
D411,738 S 6/1999 Raasch
6,109,461 A 8/2000 Kluge
6,112,913 A 9/2000 Rindoks
6,185,887 B1 2/2001 Strassle
6,195,953 B1 3/2001 Gitter
6,202,966 B1 * 3/2001 MacDonald ..... A47B 57/425 248/247
6,345,579 B1 * 2/2002 Zaturensky ..... A47B 96/028 248/250
D455,065 S 4/2002 Berg
6,363,643 B1 4/2002 Padiak
D461,657 S 8/2002 Magnusson
6,428,128 B1 8/2002 Henriott
6,497,185 B1 12/2002 Barrett
6,592,194 B2 7/2003 Lininger
D479,932 S 9/2003 Clucas
6,644,609 B1 * 11/2003 Scott ..... A47B 96/1458 248/909
D490,697 S 6/2004 Runnalls
D493,308 S 7/2004 Nilsson
6,851,653 B2 * 2/2005 Crowley ..... A47B 57/487 211/192
6,932,225 B2 * 8/2005 Rowe ..... A47B 57/30 211/90.02
6,969,036 B2 11/2005 Magnusson
7,086,543 B2 8/2006 Remmers
7,086,544 B1 8/2006 Doench
D529,254 S 9/2006 Huguet
7,121,417 B2 10/2006 Magnusson
7,178,769 B2 2/2007 Magnusson
7,188,740 B2 3/2007 Marchetta
7,243,887 B2 7/2007 Magnusson
D550,540 S 9/2007 Nawrocki
D572,125 S 7/2008 Nilsson
7,392,911 B2 7/2008 Stitchick
7,427,053 B2 9/2008 Nawrocki
D577,936 S 10/2008 Held
7,497,344 B2 * 3/2009 Chen ..... A47B 96/028 248/220.42
D592,945 S 5/2009 Mahan
7,726,615 B2 * 6/2010 Rutz ..... A47B 96/028 248/240.4
7,832,573 B2 11/2010 Magnusson
D649,026 S 11/2011 Kong
D649,027 S 11/2011 Pensi
8,087,521 B2 1/2012 Schwartzkopf
8,210,368 B2 7/2012 Schwartzkopf
D674,626 S 1/2013 Gasser
D680,361 S 4/2013 Zobel
D684,402 S 6/2013 Gasser
D684,403 S 6/2013 Gasser
8,646,624 B2 * 2/2014 Fernandez ..... A47B 47/022 211/90.03
8,684,195 B1 4/2014 Caruso
D722,831 S 2/2015 Tuang
8,950,116 B2 2/2015 Rydén
8,960,454 B2 2/2015 Magnusson
D732,864 S 6/2015 Clouse
D732,941 S 6/2015 Erickson
D733,431 S 7/2015 Kokenge
9,130,326 B2 9/2015 Meis

(56) References Cited

U.S. PATENT DOCUMENTS 9,131,771 B2 9/2015 Lindblom
9,173,506 B2 * 11/2015 Andersson ..... A47F 5/0807
D748,916 S 2/2016 Nilsson
D761,236 S 7/2016 Wengreen
9,398,819 B2 7/2016 Tsai
D766,634 S 9/2016 Nilsson
9,476,441 B2 10/2016 Strassle
D770,206 S 11/2016 Nilsson
D773,216 S 12/2016 Nilsson
9,532,663 B2 1/2017 Nilsson
9,603,468 B2 3/2017 Nilsson
D784,745 S 4/2017 Nilsson
D785,605 S 5/2017 Hochman
D789,718 S 6/2017 Gokhale
9,743,762 B1 8/2017 Beuses
9,770,122 B2 9/2017 Gonzalez
D800,185 S 10/2017 Onrat
D801,094 S 10/2017 Verna
D806,269 S 12/2017 Nilsson
D807,641 S 1/2018 Nilsson
D808,697 S 1/2018 Heckler
D809,672 S 2/2018 Brennan
D819,732 S 6/2018 Nilsson
D821,749 S 7/2018 Nilsson
D823,622 S 7/2018 Nilsson
10,012,255 B2 7/2018 Knutson
10,016,057 B1 7/2018 Arnautovic
10,028,582 B2 7/2018 Nilsson
10,051,958 B2 8/2018 Andersson
10,060,462 B2 8/2018 Nilsson
D828,744 S 9/2018 Bright
10,098,460 B1 * 10/2018 Brinton, Jr. ..... A47B 96/145
10,104,959 B2 10/2018 Nilsson
D839,029 S 1/2019 Nilsson
D843,149 S 3/2019 Nilsson
10,287,057 B2 5/2019 Nilsson
D869,195 S 12/2019 Nilsson
10,602,843 B2 3/2020 Sisto
D882,290 S 4/2020 Nilsson
10,610,016 B2 4/2020 Nilsson
10,634,279 B2 4/2020 Lu
10,653,239 B2 5/2020 Nilsson
10,906,706 B2 2/2021 Nilsson
D927,292 S 8/2021 Zussman
11,109,679 B2 * 9/2021 Richard ..... A47B 57/40
11,224,289 B1 * 1/2022 Hutson ..... A47B 96/1408
11,229,287 B2 1/2022 Nilsson
11,230,412 B2 1/2022 Nilsson
11,369,215 B2 6/2022 Obitts
11,375,812 B2 7/2022 Nilsson
D973,476 S 12/2022 Ryden
D984,257 S 4/2023 Nilsson
11,622,628 B2 * 4/2023 Kressin ..... A47B 96/066
312/245
11,696,641 B2 7/2023 Nilsson
2002/0043914 A1 4/2002 Munday
2003/0234231 A1 * 12/2003 Rowe ..... A47B 96/14
211/94.01
2004/0007550 A1 1/2004 Leeman
2005/0006541 A1 1/2005 Magnusson
2005/0011844 A1 1/2005 Magnusson
2005/0045787 A1 * 3/2005 Magnusson ..... A47B 96/024
248/250
2005/0056604 A1 3/2005 Chen
2005/0109720 A1 5/2005 Marchetta
2005/0109901 A1 5/2005 Stitchick
2005/0145588 A1 7/2005 Stitchick
2005/0150436 A1 7/2005 Marchetta
2005/0150850 A1 7/2005 Stitchick
2005/0160691 A1 7/2005 Kim
2006/0113443 A1 * 6/2006 Remmers ..... A47B 57/42
248/235
2007/0023375 A1 2/2007 Fedewa
2007/0221595 A1 9/2007 Chen
2007/0221597 A1 * 9/2007 Chen ..... A47B 57/40
211/192
2007/0262037 A1 * 11/2007 Cheng ..... A47B 57/482
211/103
2008/0116329 A1 5/2008 Magnusson
2008/0142669 A1 6/2008 Zlotocha
2008/0173778 A1 7/2008 Mertens
2008/0217496 A1 * 9/2008 Wooten ..... A47B 96/061
248/248
2008/0237426 A1 10/2008 Walters
2008/0272076 A1 * 11/2008 Davenport ..... A47B 57/42
211/90.01
2009/0139943 A1 6/2009 Fernandez
2009/0242497 A1 10/2009 Nilsson
2010/0001159 A1 1/2010 Kao
2010/0300999 A1 12/2010 Schwartzkopf
2011/0042333 A1 2/2011 Magnusson
2011/0219706 A1 9/2011 Bates
2012/0255925 A1 10/2012 Fernandez
2013/0199099 A1 8/2013 Ryden
2014/0138332 A1 5/2014 Loree
2015/0076983 A1 3/2015 Lindblom
2015/0152904 A1 6/2015 Nilsson
2015/0296982 A1 10/2015 Chen
2015/0335155 A1 * 11/2015 Winker ..... A47B 96/021
211/90.02
2016/0060935 A1 3/2016 Nilsson
2016/0060936 A1 3/2016 Nilsson
2016/0100685 A1 * 4/2016 Tibbe ..... A47B 96/061
248/220.22
2016/0227944 A1 8/2016 Gonzalez
2016/0316939 A1 11/2016 Kraiss
2017/0081077 A1 3/2017 Nilsson
2017/0112282 A1 4/2017 Will
2017/0119150 A1 5/2017 Andersson
2017/0311717 A1 11/2017 Nilsson
2018/0132610 A1 5/2018 Lu
2018/0132611 A1 * 5/2018 Lu ..... A47B 61/003
2018/0135796 A1 5/2018 Lu
2018/0352953 A1 12/2018 Nilsson
2019/0110595 A1 4/2019 Nilsson
2019/0387902 A1 12/2019 Peck
2020/0113329 A1 4/2020 Nilsson
2020/0187675 A1 6/2020 Obitts
2020/0288866 A1 * 9/2020 Richard ..... A47B 96/06
2020/0323340 A1 10/2020 Nilsson
2021/0274933 A1 9/2021 Nilsson
2021/0337966 A1 11/2021 Nilsson
2021/0337967 A1 11/2021 Nilsson
2021/0394954 A1 12/2021 Nilsson
2022/0047071 A1 2/2022 Nilsson
2022/0338627 A1 10/2022 Ringenhag
2023/0023464 A1 1/2023 Nilsson
2023/0026525 A1 1/2023 Nilsson
2023/0192355 A1 6/2023 Nilsson

FOREIGN PATENT DOCUMENTS

CN 101384146 A 3/2009
CN 201782324 U 4/2011
CN 102113777 A 7/2011
CN 203572135 U 4/2014
CN 104145535 A 11/2014
CN 203934885 U 11/2014
DE 8909339 U1 11/1989
DE 10020772 C1 1/2002
EP 1656049 A1 5/2006
EP 2090197 A1 8/2009
EP 2372064 A1 10/2011
ES 233096 U 3/1978
GB 803789 A 10/1958
GB 1503214 A 3/1978
GB 2169791 7/1986
GB 2284745 A 6/1995
JP S4618350 Y 6/1971
JP S51123123 U 10/1976
JP H0965957 A 3/1997
JP 2002051852 A 2/2002

(56) References Cited

FOREIGN PATENT DOCUMENTS

| | | | | |
|---|---|---|---|---|
| JP | 2010269078 | A | 12/2010 | |
| RU | 2082307 | C1 | 6/1997 | |
| RU | 8571 | U1 | 12/1998 | |
| RU | 30249 | U1 | 6/2003 | |
| RU | 80099 | U1 | 1/2009 | |
| RU | 134755 | U1 | 11/2013 | |
| RU | 2014123979 | A | 12/2015 | |
| RU | 2579735 | C2 | 4/2016 | |
| SE | 504960 | C2 | 6/1997 | |
| SE | 544174 | C2 | 2/2022 | |
| TW | I578884 | B | 4/2017 | |
| TW | I633859 | B | 9/2018 | |
| WO | 1994024440 | A1 | 10/1994 | |
| WO | 1994027474 | A1 | 12/1994 | |
| WO | 2004056236 | | 7/2004 | |
| WO | 2008060221 | A2 | 5/2008 | |
| WO | 2013071977 | A1 | 5/2013 | |
| WO | 2013191624 | A1 | 12/2013 | |
| WO | 2015050868 | A1 | 4/2015 | |
| WO | WO-2015050868 | A1 * | 4/2015 | ..... A47B 47/00 |
| WO | 2015189142 | A1 | 12/2015 | |
| WO | 2016077717 | A1 | 5/2016 | |
| WO | 2016176915 | A1 | 11/2016 | |
| WO | 2019069284 | A1 | 4/2019 | |
| WO | 2019083632 | A1 | 5/2019 | |
| WO | WO-2019083632 | A1 * | 5/2019 | ..... A47B 47/022 |
| WO | 2020055438 | A1 | 3/2020 | |
| WO | 2021061683 | A1 | 4/2021 | |
| WO | WO-2021133240 | A1 * | 7/2021 | ..... A47B 57/10 |

OTHER PUBLICATIONS

Elfa, Product List, Ver. 1, Oct. 2016, 32 pages.

International Search Report and Written Opinion for International Patent Application PCT/SE2021/050395 dated May 14, 2021.

International Search Report and Written Opinion from PCT/SE2021/050396 dated May 19, 2021.

International Search Report and Written Opinion received in Patent Cooperation Treaty Application No. PCT/SE2020/051246, dated Feb. 15, 2021.

* cited by examiner

SHELF STORAGE SYSTEM

RELATED APPLICATION

This application, a national phase application of Patent Cooperation Treaty Application No. PCT/SE2020/051246 filed Dec. 21, 2020, which claims priority to Swedish Application No. 1951548-5 filed Dec. 23, 2019.

FIELD OF THE INVENTION

The present disclosure relates to a shelf storage system, comprising a plurality of hang standards, adapted to be vertically arranged on a wall or the like, the hang standards comprising a plurality of slots arranged in rows therein, the system further comprising a plurality of brackets having connector means for connecting with hang standard slots in such a way that each bracket becomes suspended from the hang standard in a cantilevered manner, and at least one shelf, adapted to rest on and span at least first and second such suspended brackets.

TECHNICAL BACKGROUND

Such shelf storage systems have been available for over 50 years. One advantage with systems of this kind is that they can be configured in different ways by connecting brackets at different slots in the hang standards.

One problem associated with shelf storage systems of this kind is how to make installing easier, especially since usually an end user purchases a system in parts and makes the installation in his or her home without help from service staff or the like.

SUMMARY OF THE INVENTION

One object of the present disclosure is therefore to provide a shelf storage system that is easier to install. This object is achieved by a shelf storage system as defined in claim 1. More specifically, in a shelf storage system of the initially mentioned kind, the shelf comprises on its bottom side at least first and second shelf connector means, being adapted to connect with said first and second bracket, respectively. The first and second shelf connector means are located mutually spaced apart with a predetermined bracket distance, and the hang standard comprises a plurality of screw holes for connecting the hang standard oriented vertically to a wall or the like, wherein the distance between at least two such screw holes corresponds to said bracket distance.

This means that the user, by means of one hang standard, which is temporarily oriented horizontally on a wall, can precisely mark locations for screw holes for one or more other hang standards, which thereby will be sufficiently accurately placed on the wall to allow a shelf to be connected to two or more brackets with the shelf connector means. This marking can be done without using a folding rule or the like. Thereby, installing of a shelf storage system becomes significantly easier.

In a simple example, the shelf connector means may comprise one or more bores in the shelf. However, it may be advantageous to provide the shelf connector means with connector sleeves embedded in the bores in the shelf surface.

The bracket-to-bracket distance may be a whole number multiple of the cc distance between two consecutive slots in a row of slots of a hang standard. This makes the screw holes fit smoothly into the slot pattern in the hang standard, such that more slots, and therefore more bracket connection options, can be provided in the hang standard. Typically, the distance x between two consecutive slots in a row of slots may be 32 mm and the distance d between two screw holes may be 640 mm.

The present disclosure further considers a hang standard for such a shelf storage system, the hang standard comprising a plurality of slots arranged in rows therein, the hang standard comprising a plurality of screw holes for connecting the hang standard, oriented vertically, to a wall or the like, wherein the distance d between at least two such screw holes is a whole number multiple of the cc distance x between two consecutive slots in a row of slots of a hang standard. Typically, the distance x between two such consecutive slots in a row of slots may be 32 mm and the distance d between two such screw holes may be 640 mm.

DETAILED DESCRIPTION

Figure 1:
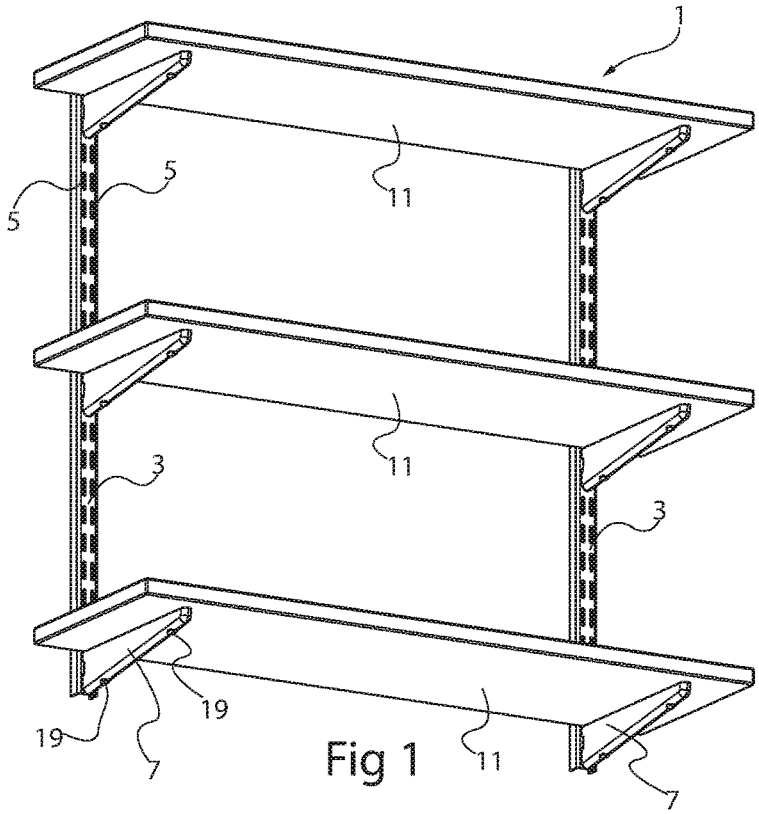
FIG. 1 shows an example of a shelf system.

The present disclosure relates to a shelf system 1, one example of which is illustrated in FIG. 1. The system 1 comprises two or more of hang standards 3, which are adapted to be vertically arranged on a wall or the like. In principle, such hang standards can be provided with feet that allow a free-standing configuration, but the present disclosure is mainly concerned with cases where the hang standards 3 are attached to a wall or other vertically oriented surface by means of screws (not shown) or the like and sometimes in combination with plaster anchors or similar.

The hang standards 3 are usually made in a single elongated sheet metal piece which is bent into a U-shaped cross section and comprises a plurality of slots 5 arranged in rows in the mid-section of the U-shape. When attached to the wall, the hang standard 3 is oriented with the mid-section distant from the wall such that there is created a space behind the rows of slots 5.

A plurality of brackets 7 can be connected to each hang standard 3 in a cantilevered fashion. To this end the brackets 7 comprise connector means 9 (cf. FIG. 12) for connecting with hang standard slots 5, where the connector means 9 can reach into the aforementioned space behind the slots.

Then, a shelf 11 is placed on two or more brackets 7 located on equal height, such that the shelf spans between the brackets 7, and the shelf 11 is attached to the brackets 7 by connecting means 19. Traditionally, those connecting means 19 have been in the form of wood screws that are inserted through holes in the bottom of the brackets 7 and are screwed into the shelf 11. This stops the shelf 11 from moving in any direction of its plane while it is suspended by the brackets 11.

Figure 2:
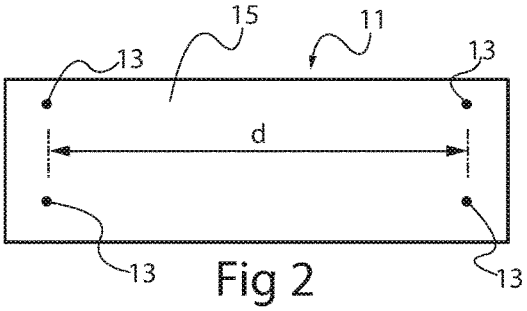
FIGS. 2 and 3 show front views of the bottom sides of shelves with two different sizes.

The present disclosure describes an arrangement that makes the assembling of the shelf easier, and the assembled shelf system also becomes more easily reconfigurable. This is accomplished by providing shelf connector 13 means in the bottom side of the shelf 11, as is illustrated in FIGS. 2 and 3, depicting front views of the bottom sides 15 of shelves 11 with two different sizes. These shelf connector means 13 may in their simplest form be drilled bores in the bottom side 15. In any case, the shelf connector means 13 are configured to cooperate with bracket connector means associated with the bracket 7. The shelf connector means 13 are prepared at manufacturing of the shelf, and one or more shelf connector means 13 intended for one bracket 7 are located at predetermined bracket-to-bracket distances d from other shelf connector means 13 intended for another bracket 7.

In the case illustrated in FIG. 2, a shelf 11 intended to rest on two brackets is shown, where the bracket-to-bracket distance d is 640 mm, for instance, and two bores are prepared for each bracket 7 and form shelf connector means 13.

Figure 3:
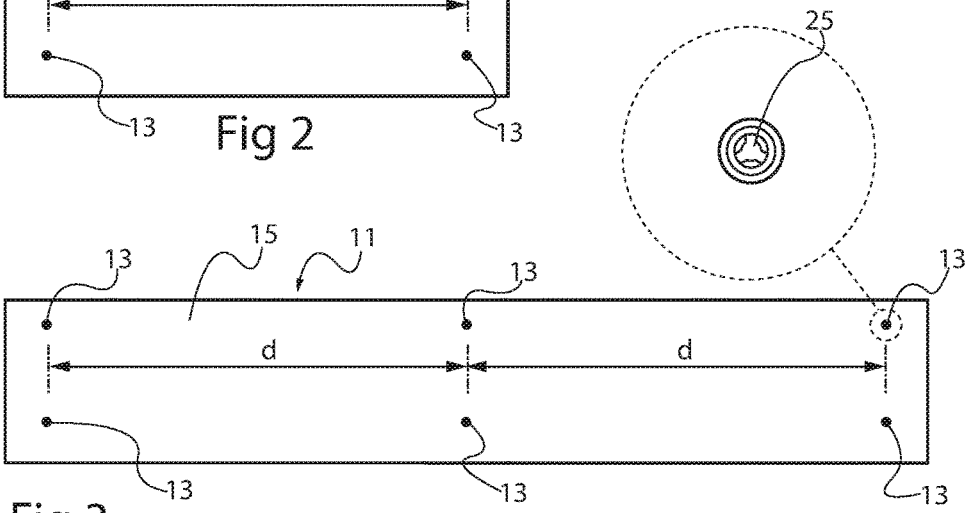

In the case illustrated in FIG. 3, a shelf 11 intended to rest on three brackets 7 is shown, also having the bracket-to-bracket distance d of 640 mm and with two bores are prepared for each bracket 7. In addition to a bore, the shelf connector means may comprise a coupling sleeve 25 embedded in the bore as illustrated in the enlarged portion of FIG. 3, and as will be discussed further.

Figure 12:
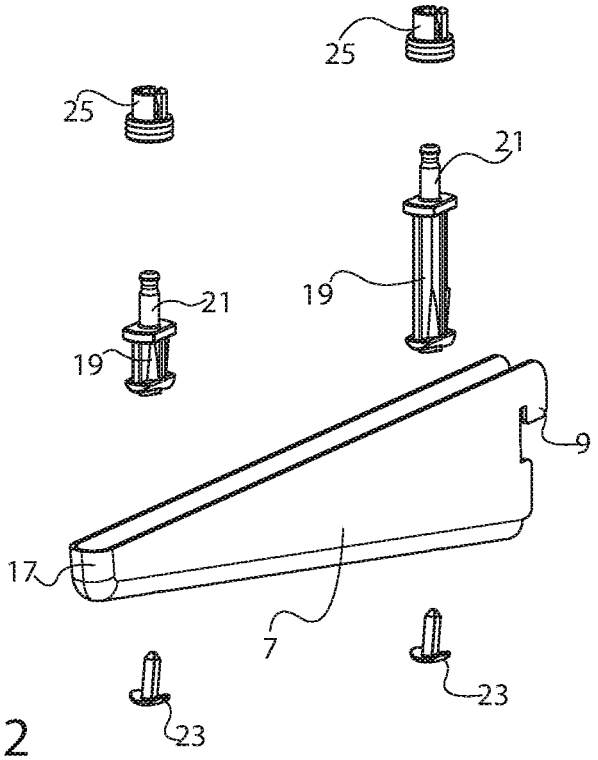
FIG. 12 illustrates one example of components suitable for connecting a bracket to a shelf.

FIG. 12 illustrates one example of components suitable for connecting a bracket 7 to a shelf 11. As illustrated, the bracket 7 may be bade of a single sheet metal piece, and may have a generally U-shaped cross section, the depth of which tapers from the connector 9, used to connecting the bracket 7 to a hang standard 3, and towards its cantilevered distal end 17. In this example, inserts 19 with different heights are inserted into the U-shaped cross section of the bracket 7. The inserts 19 may be made of plastic and are adapted to fit in the different depths of the U-shaped cross section at the location where they are inserted. Each insert comprises an upwardly projecting dowel 21, which projects upwards from the top edges of the bracket 7, when the insert 19 is inserted therein, and into a shelf connector means 13 of a shelf 11. When inserted in the bracket 7, the inserts 19 can be fixed therein by inserting lock plugs 23 from below through holes in the brackets 7 and extending into sockets in the bottom of the inserts 19.

The dowels 21 may interact with a coupling sleeve 25 (cf. also FIG. 3), embedded in a bore in the shelf 11, for instance by means of a snap fit.

However, other means for connecting the brackets 7 to the shelf 11 may be considered, for instance simply dowels integrally formed with the bracket entering bores in the shelf 11.

Figure 4:
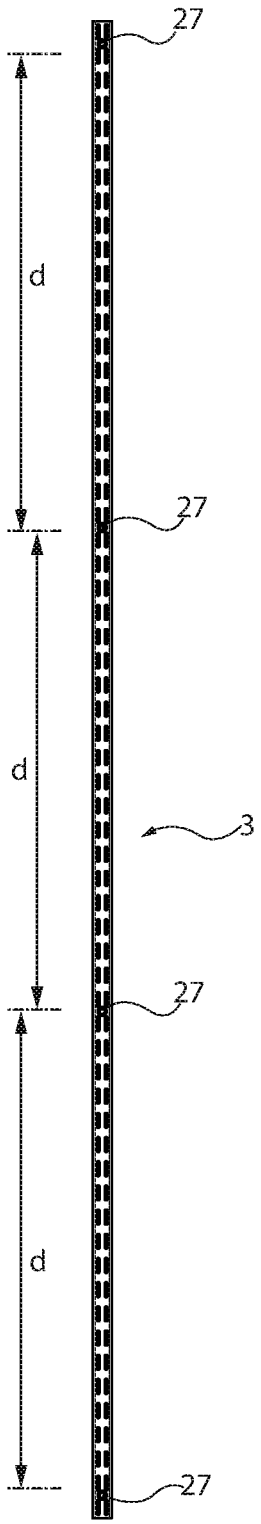
FIGS. 4-6 show examples of hang standards with three different sizes.
Figure 5:
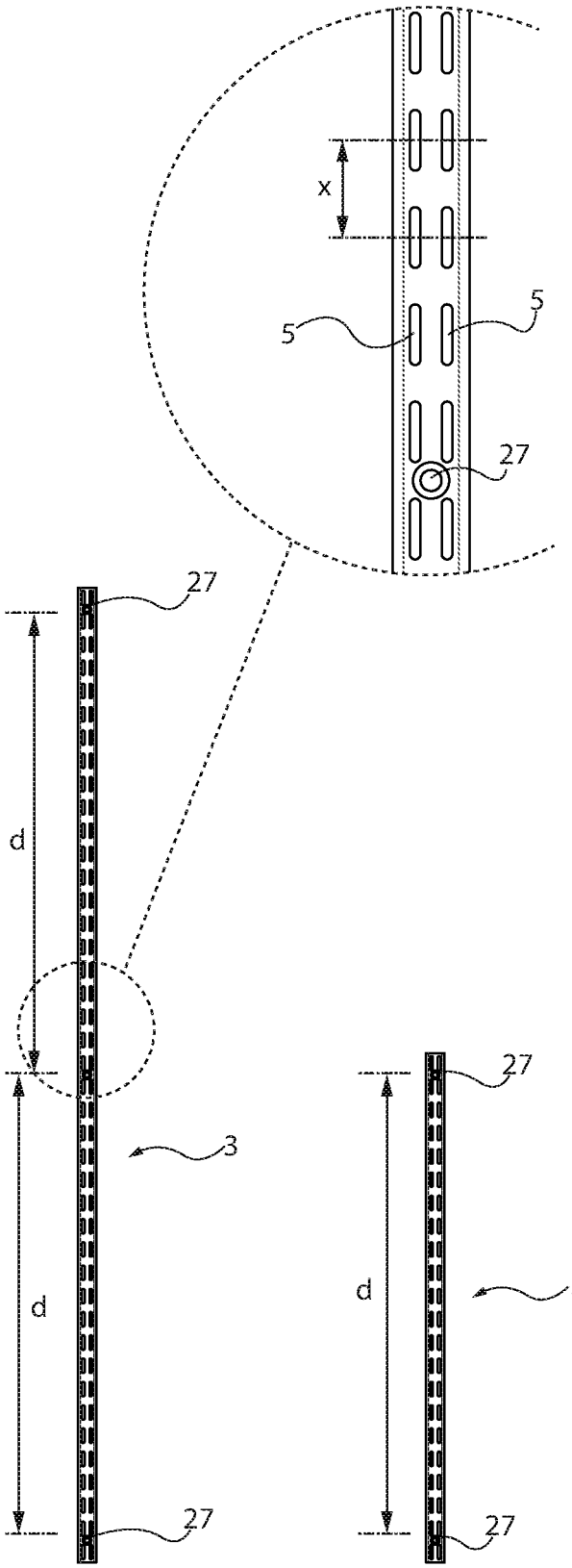
Figure 6:
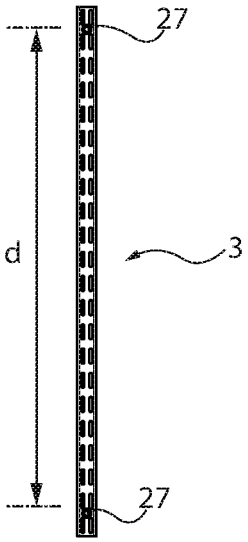
Figure 7:
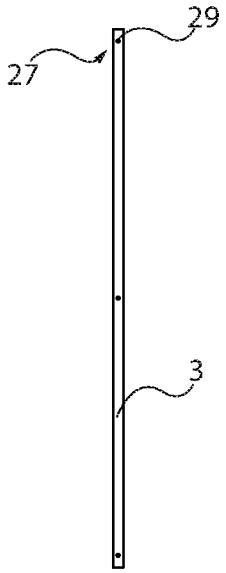
FIGS. 7-11 illustrates fastening of a shelf system on a wall according to the present disclosure.

Using the above connecting means implies that the brackets 7 should be located spaced apart at a correct distance from each other in order to allow the shelf 11 to be attached thereto. While this can be achieved by a skilled end user by means of a folding rule or the like, the present disclosure provides means for achieving this more easily. FIGS. 4-6 show examples of hang standards 3 with three different sizes (in the shown example: 1980 mm in FIG. 4, 1340 mm in FIG. 5, and 700 mm in FIG. 6). Those hang standards 3 however, may have more or less identical cross sections, and may have identical slot 5 patterns, in the illustrated case, the c-c distance x between two consecutive slots 5 in a row may be 32 mm (cf. enlarged portion of FIG. 5).

The hang standards comprise screw holes 27 for connecting the hang standards 3 oriented vertically to a wall or the like. In the present disclosure, the distance d between at least two such screw holes 27 corresponds to the desired bracket distance, i.e. the bracket to bracket distance d (cf. FIGS. 2-3) needed to cooperate with the shelf connector means 13 in the shelves. This allows simplified assembling of the shelf storage system 1, as will now be described. The bracket distance d is a whole number multiple of the cc distance x between two consecutive slots 5 in a row of slots of a hang standard. Although this is not necessary, it makes the screw holes fit smoothly into the slot 5 pattern. The screw holes are more or less circular to allow precise measuring as will be described.

FIGS. 7-11 illustrates fastening of a shelf system on a wall according to the present disclosure. In a first step, illustrated in FIG. 7, a user provides a screw 29 through an upper screw hole 27 in a hang standard 3 and attaches the screw to the wall, optionally using a plaster anchor or the like. This hang standard is of the type shown in FIG. 5, having three screw holes 27. The hang standard 3 can pivot about the single screw 29.

Figure 8:
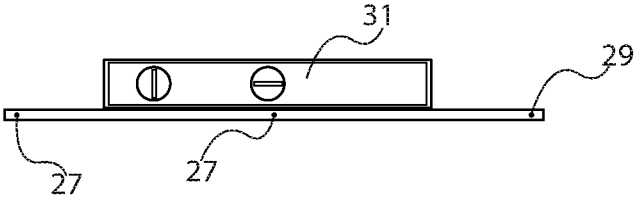

In FIG. 8, the user has turned the hang standard 3 about this pivot to a horizontal orientation that may be carefully determined using a spirit-level 31. In this position, the so far unused screw holes 27 may be used to mark locations for other hang standards. Typically, marks may be made with a pencil. To further facilitate this, it is optionally possible to temporarily attach the hang standard (cf. FIG. 7) with the mid-section of the U-shaped cross section closest to the wall, such that the screw holes 27 abut the wall.

Figure 9:
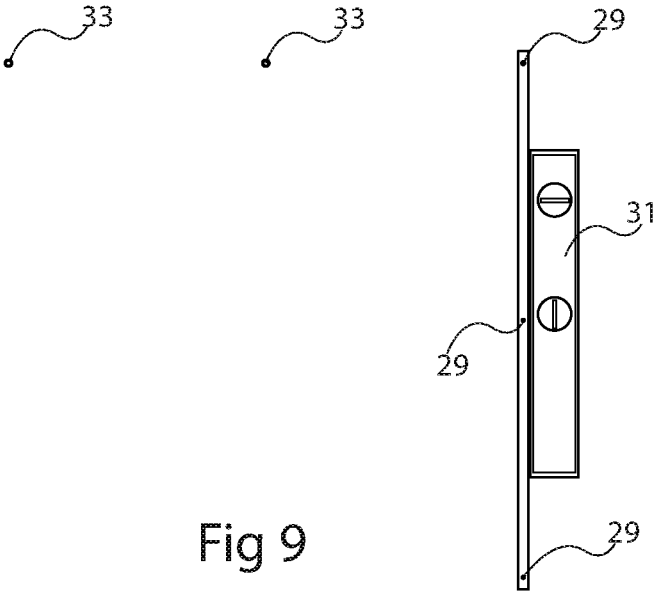

Once marks 33 have been made on the wall, as illustrated in FIG. 9, the hang standard 3 may be swung to a vertical orientation, typically determined using the spirit-level 31, and screws 29 may be attached in the two remaining screws holes to firmly attach the hang standard 3 to the wall. Now, the hang standard 3 is arranged with the mid-section of the U-shaped cross section distant from the wall.

Figure 10:
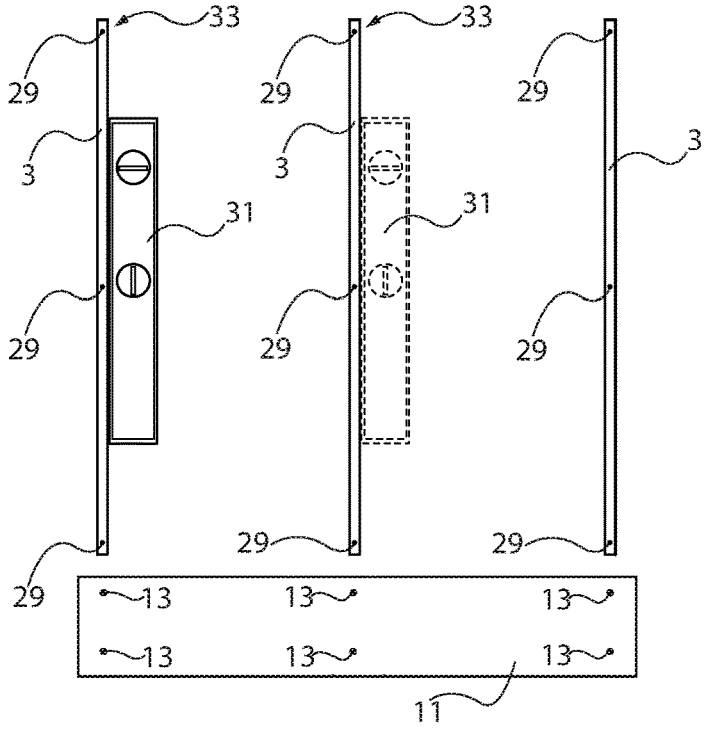

When the first hang standard 3 is firmly attached to the wall, further hang standards 3 may be attached, as illustrated in FIG. 10, vertically to the wall with screws 29, using the aforementioned marks 33. The spirit-level 31 may be used to ensure a vertical orientation.

As shown in FIG. 10, the hang standards 3 are now mutually more or less perfectly located on the wall such that brackets 7 attached thereto can connect to shelf connector means 13 in a shelf 11, a bottom side of which is shown below the hang standards 3.

Figure 11:
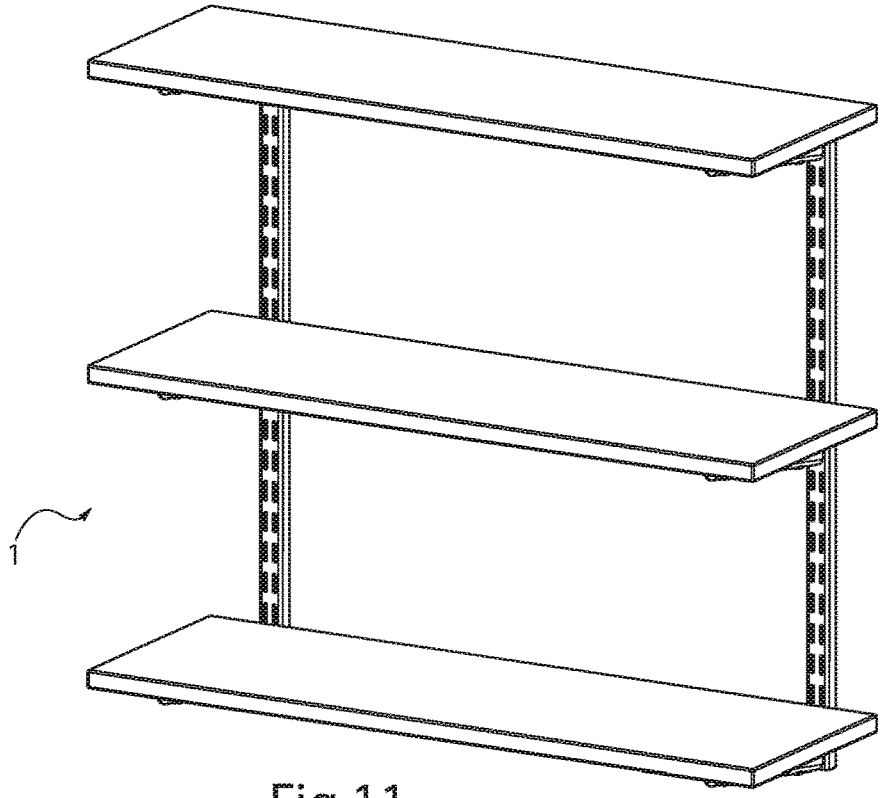

Therefore, a finished shelf storage system 1 can easily be provided. illustrated in FIG. 11 with a smaller two-hang standard version.

In this way, thanks to the screw hole configuration in the hang standards 3, no folding rule or similar is needed and the hang standards become very accurately located on the wall to facilitate the assembling.

The present disclosure is not restricted to the above examples and may be varied and altered in different ways within the scope of the appended claims.

The invention claimed is:

1. A shelf storage system comprising a plurality of hang standards, adapted to be vertically arranged on a wall, the hang standards comprising a plurality of slots arranged in rows therein, the shelf storage system further comprising a plurality of brackets, each comprising connector means for connecting with the hang standard slots to suspend the bracket in a cantilevered manner, and at least one shelf adapted to rest on and span at least a first and a second suspended bracket;

wherein the shelf has a bottom side that comprises at least first and second shelf connector means to connect with said first and second suspended brackets, respectively, the first and second shelf connector means being located mutually spaced apart with a predetermined bracket to bracket distance d, and wherein each of the plurality of hang standards comprises a plurality of screw holes for connecting the hang standard oriented vertically to a wall, wherein the distance between at least two of the plurality of screw holes corresponds to said bracket to bracket distance d.

2. The shelf storage system according to claim 1, wherein the shelf connector means comprise bores in the shelf.

3. The shelf storage system according to claim 2, wherein the shelf connector means further comprise connector sleeves embedded in the shelf surface.

4. The shelf storage system according to claim 3, wherein said bracket to bracket distance d is a whole number multiple of a cc distance x between two consecutive slots in one of the rows slots.

5. The shelf storage system according to claim 4, wherein the cc distance x between two consecutive slots in a row of slots is 32 mm and the distance d between two screw holes is 640 mm.

6. The shelf storage system according to claim 1, wherein said bracket to bracket distance d is a whole number multiple of a cc distance x between two consecutive slots in one of the rows of slots.

7. The shelf storage system according to claim 6, wherein the distance x between two consecutive slots in a row of slots is 32 mm and the distance d between two screw holes is 640 mm.

8. The shelf storage system according to claim 2, wherein said bracket to bracket distance d is a whole number multiple of a cc distance x between two consecutive slots in one of the rows slots.

9. The storage system according to claim 8, wherein the cc distance x between two consecutive slots in a row of slots is 32 mm and the distance d between two screw holes is 640 mm.

10. In a modular shelf storage system having a shelf of predetermined length that is adapted for being supported between cantilevered brackets spaced apart at a predetermined bracket-to-bracket distance, hang standard comprising:

a plurality of slots arranged in rows therein, from which brackets can be suspended in a cantilevered manner in a cantilevered manner to support one end of the shelf; and a plurality of screw holes for connecting the hang standard oriented vertically to a wall;

wherein a distance d between at least two of the plurality of screw holes is a whole number multiple of a cc distance x between two consecutive slots in a row of slots of the hang standard and is the same as the predetermined bracket-to-bracket distance.

11. The hang standard according to claim 10, wherein the cc distance x between two consecutive slots in a row of slots is 32 mm and the distance d between two screw holes is 640 mm.

12. A method of installing a shelf storage system, comprising:

providing a plurality of hang standards, the plurality of hang standards comprising at least a first hang standard and a second hang standard, each of the plurality of hang standards comprising a plurality of slots arranged in at least one column therein and a plurality of screw holes for connecting the hang standard oriented vertically to a vertical surface, at least two of the plurality of screw holes being spaced apart by a predetermined bracket-to-bracket distance;

orienting horizontally the first hang standard on the vertical surface;

marking on a vertical surface locations for the first and the second hang standards using the at least two of the plurality of screw holes in the first hang standard;

attaching to the vertical surface the first and second hang standards in a vertical orientation at the marked locations;

providing a plurality of brackets, the plurality of brackets comprising at least a first bracket and a second bracket, the first and second brackets each having a connector at one end of the bracket that is capable of cooperating with one or more of the plurality of slots of the first and second hang standards, respectively, to suspend the bracket in a cantilevered manner from the hang standard;

attaching the first bracket and the second bracket to the first and second hang standards, respectively;

providing a shelf adapted to rest on and span at least two of the plurality of brackets, the shelf comprising at least a first connector and a second connector at fixed locations on the shelf that are spaced apart by the predetermined bracket-to-bracket distance; and attaching the shelf using the first and second connectors to the first and second brackets, respectively.

13. The method of claim 12, wherein the predetermined bracket-to-bracket distance is a whole number multiple of a cc distance x between any two consecutive slots in the at least one column of slots of the first hang standard.

* * * * *